United States Patent [19]

Becker

[11] Patent Number: 4,463,700

[45] Date of Patent: Aug. 7, 1984

[54] RUDDER FOR WATERCRAFT

[75] Inventor: Willi Becker, Hamburg, Fed. Rep. of Germany

[73] Assignee: Willi Becker Ingenieurbüro GmbH, Hamburg, Fed. Rep. of Germany

[21] Appl. No.: 349,081

[22] PCT Filed: Oct. 30, 1981

[86] PCT No.: PCT/DE81/00186

§ 371 Date: Feb. 11, 1982

§ 102(e) Date: Feb. 11, 1982

[87] PCT Pub. No.: WO82/01528

PCT Pub. Date: May 13, 1982

[30] Foreign Application Priority Data

Nov. 5, 1980 [DE] Fed. Rep. of Germany ..... 3041661

[51] Int. Cl.[3] ..... B63H 25/06

[52] U.S. Cl. ..... 114/162; 114/165

[58] Field of Search ..... 114/162–169; 16/230, 228, DIG. 33; 403/113, 119, 151, 167, 187, 192; 308/DIG. 12

[56] References Cited

U.S. PATENT DOCUMENTS

| | | | |
|---|---|---|---|
| 2,896,806 | 7/1959 | Vossenberg | 16/230 |
| 2,996,031 | 8/1961 | Easter | 114/167 |
| 4,024,827 | 5/1977 | Becker | 114/162 |
| 4,158,511 | 6/1979 | Herbenar | 403/113 |
| 4,256,388 | 3/1981 | Beyer | 16/228 |

FOREIGN PATENT DOCUMENTS

| | | | |
|---|---|---|---|
| 601903 | 7/1960 | Canada | 114/162 |
| 947949 | 8/1956 | Fed. Rep. of Germany | 114/162 |
| 2353934 | 7/1974 | Fed. Rep. of Germany | 114/162 |

*Primary Examiner*—Trygve M. Blix
*Assistant Examiner*—Stephen P. Avila
*Attorney, Agent, or Firm*—Toren, McGeady and Stanger

[57] ABSTRACT

The invention relates to a rudder for watercraft with a stabilizer (13) articulated to the rudder blade (11), the stabilizer and the rudder blade being connected in articulated manner by articulated blades and several connecting bolts. The in each case upper articulated bush is supported on the in each case lower articulated bush, accompanied by the interposing of a self-adjusting, annular centering device mounted in free-floating manner and taking up the axial weight.

4 Claims, 7 Drawing Figures

RUDDER FOR WATERCRAFT

Figure 1:
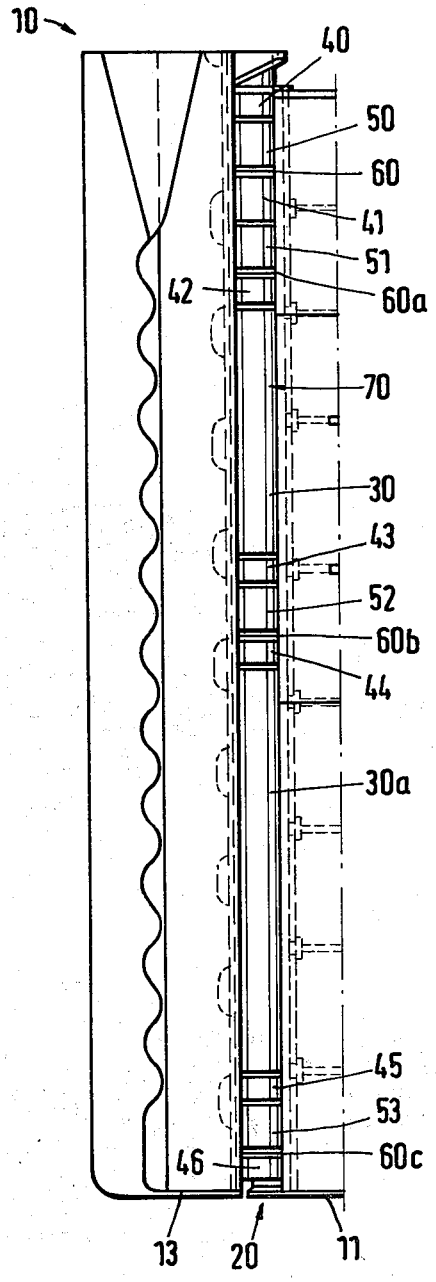

The invention relates to a rudder for watercraft, particularly ocean-going and inland navigation vessels and for floating gear, comprising a rudder blade with a stabilizer articulated thereto.

The articulation of a stabilizer to a rudder blade of rudders for watercraft takes place by means of hinge-like articulated connections constructed in per se known manner, but which do not permit an adequate weight distribution from the stabilizer to the rudder blade.

The problem of the present invention is to provide a suitable articulation of the stabilizer to the rudder blade in the case of rudders for watercraft in which there is at least one two-point contact bearing of the connecting bolt positioned in the articulation area between the stabilizer and the rudder blade, together with an axial taking up of weight accompanied by the simultaneous self-adjustment of the joint bolt receiving the connecting bolt. In addition, it is possible to divert the weight of the stabilizer into the rudder blade.

In connection with a ruddr for watercraft of the aforementioned type, this problem is solved in that the stabilizer and the rudder blade are interconnected in an articulated manner by means of a device comprising a plurality of aligned protective tubes arranged in spaced manner on the stabilizer, accompanied by the formation of gaps, at least two high-grade steel articulated bushes positioned above the uppermost protective tube and below the lowermost protective tube in the gap between two protective tubes, whereof one articulated bush is fixed to the stabilizer and the other to the rudder blade and whereof the upper articulated bush is supported on the lower articulated bush, accompanied by the interposing of a self-adjusting, annular centering device, mounted in free-floating manner and taking up the axial weight, and a connecting bolt passed through the protective tubes, the articulated bushes and the annular centering devices and which comprises a plurality of detachably interconnected individual bolts.

A floating bolt joint constructed in this way provides an easy adjustability of the stabilizer with respect to the rudder blade and also a simple manufacture of the articulation. The connecting bolt can be easily fitted and removed, because it comprises a plurality of detachably interconnected individual bolts. The individual bolts advantageously arranged in the protective tube area then serve as stock bolts and can be used in place of worn individual bolts. Thus, replacement bolts are available in the connecting area between stabilizer and rudder blade. In addition, the connecting and articulating device has a construction which is advantageous from the flow standpoint, so that the gap resulting from the design can be kept very small. Advantageously, the connecting bolt or individual bolts are fitted or removed from below, so that there is no longer any need to disassemble the complete rudder when replacing the connecting bolt. Furthermore, due to its design, the connecting mechanism according to the invention can take up axial forces. In addition, the weight of the stabilizer is diverted into the rudder blade. Advantageously, the self-adjustability of the articulated bushes or members is ensured by the radially and axially floating intermediate rings or spacers of the centering devices used.

Further advantageous developments of the invention can be gathered from the subclaims.

The invention is described in greater detail hereinafter relative to non-limitative embodiments and the attached drawings, wherein show:

FIG. 1 a side view of a rudder for watercraft comprising a stabilizer and a rudder blade.

Figure 2:
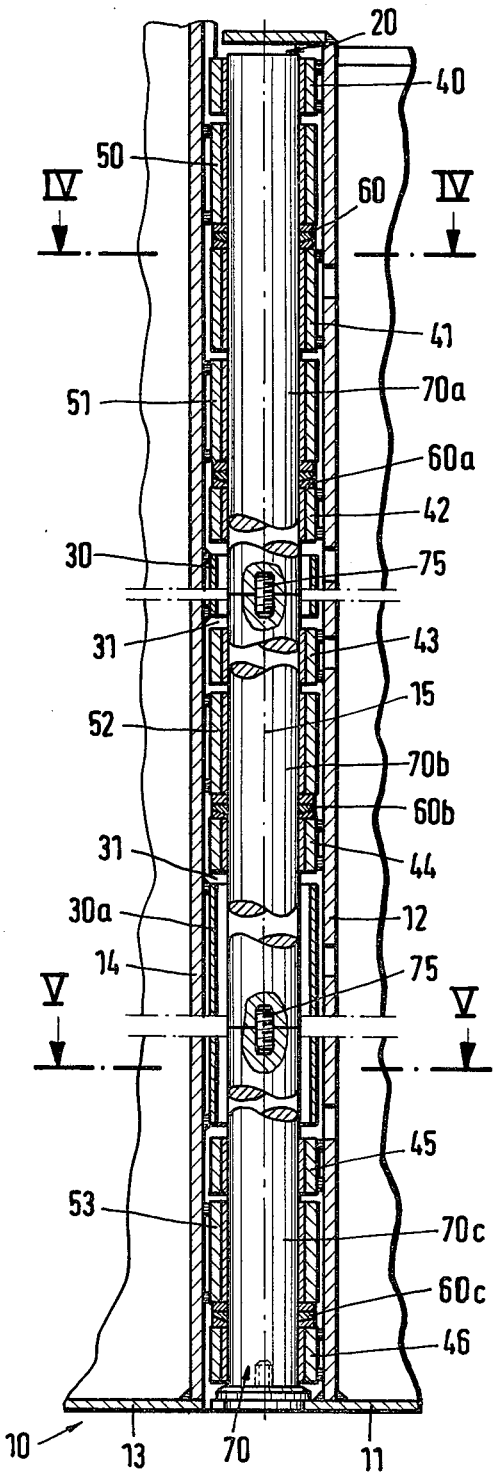

FIG. 2 the articulation area of the stabilizer to the rudder blade, partly in elevation and partly in a vertical longitudinal section.

Figure 3:
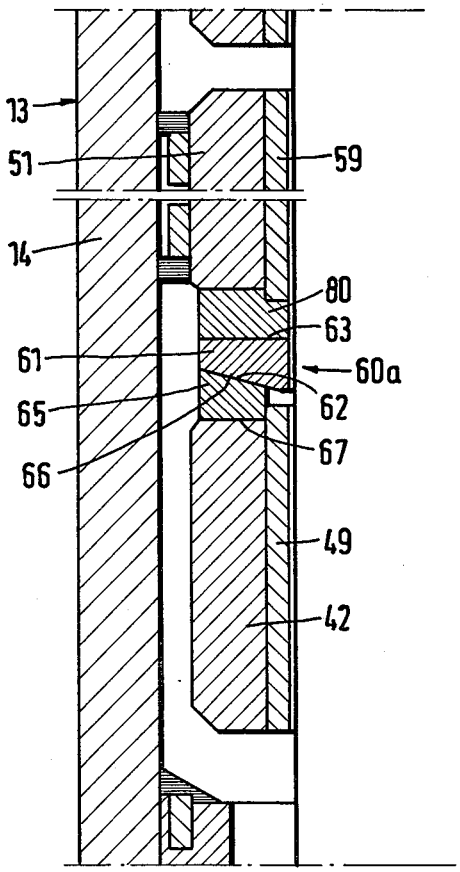

FIG. 3 a larger-scale representation of detail A in FIG. 2.

Figure 4:
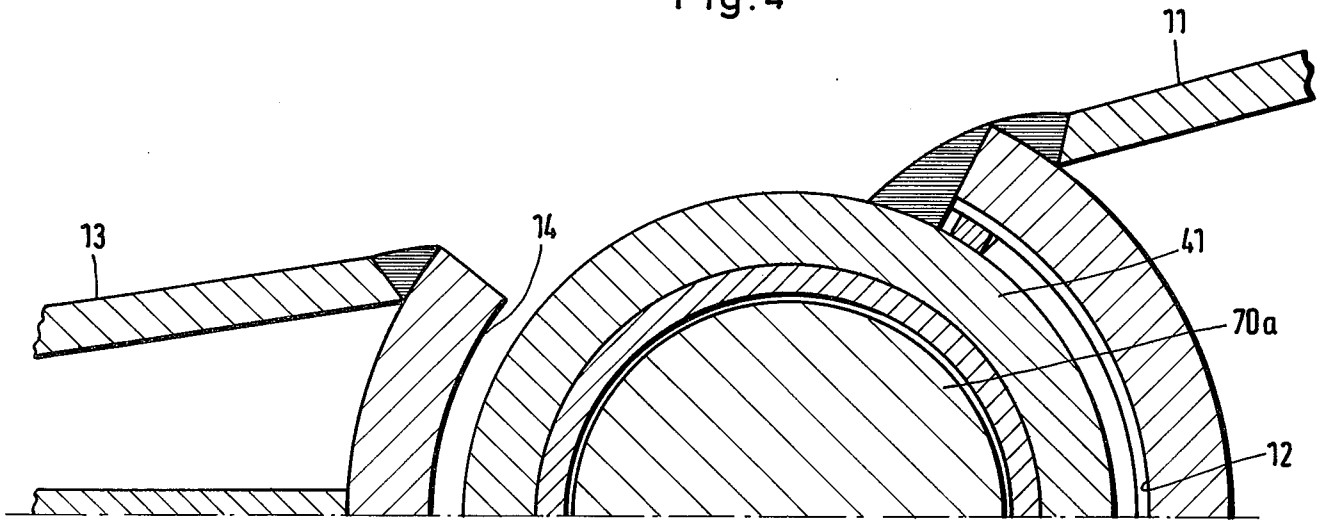

FIG. 4 a horizontal partial section along line IV—IV of FIG. 2.

Figure 5:
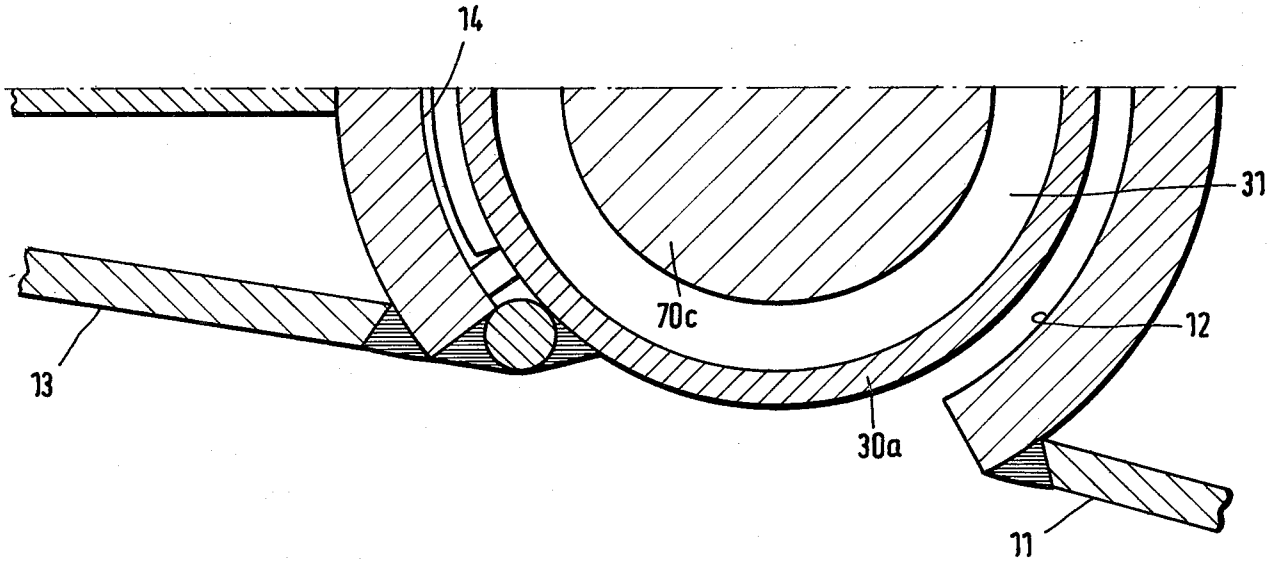

FIG. 5 a horizontal partial section along line V—V of FIG. 2.

Figure 6:
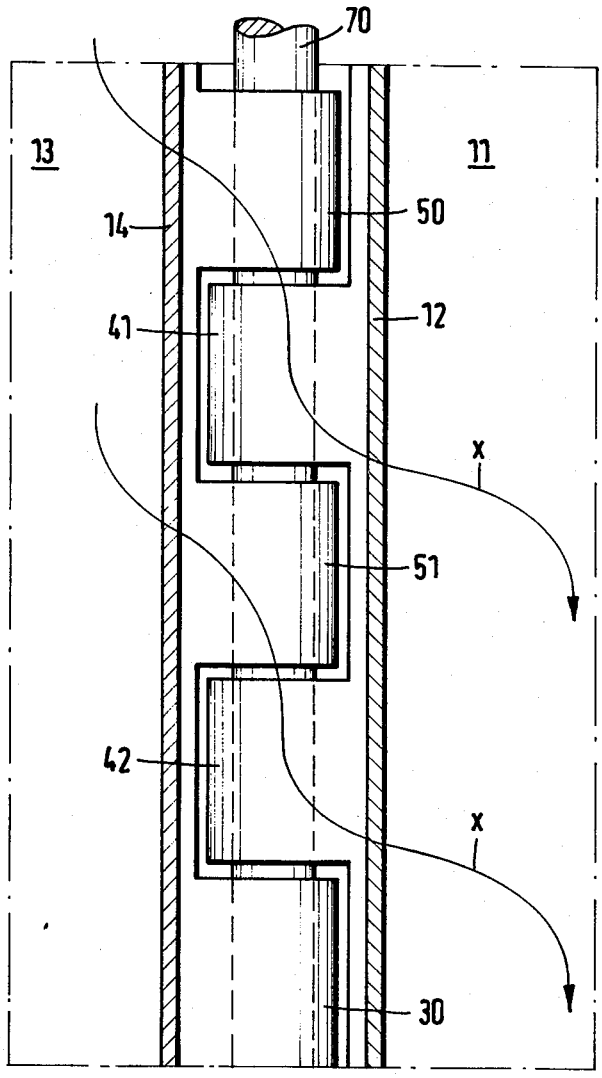

FIG. 6 a side view of the taking up of the stabilizer weight by the rudder blade.

Figure 7:
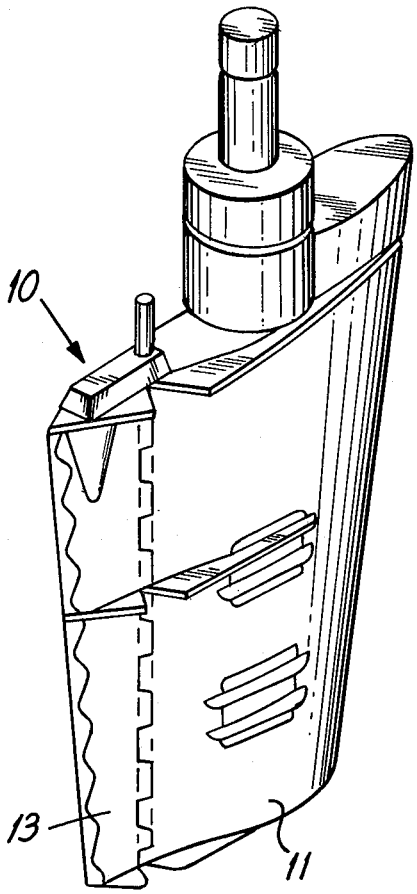

FIG. 7 is a perspective view of the rudder showing the stabilizer and rudder blade.

Rudder 10 for watercraft, particularly ocean-going and inland navigation vessels and for floating gear comprises, according to the embodiment shown in FIG. 2, a rudder blade 11 and a stabilizer 13 articulated thereto. Both rudder blade 11 and stabilizer 13 have in the articulation area facing part-circular wall surfaces 12 and 14, by means of which rudder blade 11 and stabilizer 13 are interconnected by the connecting mechanism 20 (FIGS. 4 and 5).

Connecting mechanism 20 comprises two spaced, aligned protective tubes 30, 30*a* fixed to the part-circular wall surface 14 of stabilizer 13. The gap between the two protective tubes 30 and 30*a* is indicated at 31.

In addition, the connecting mechanism comprises a plurality of articulated bushes alternately fixed to rudder blade 11 and stabilizer 13 and positioned above the top protective tube 30, below the bottom protective tube 30*a* and in the gap 31 between the two protective tubes 30, 30*a*.

In the case of the embodiment shown in FIG. 2, seven articulated bushes 40, 41, 42, 43, 44, 45 and 46 are positioned on rudder blade 11 and four articulated bushes 50, 51, 52 and 53 on stabilizer 13. The arrangement of articulated bushes 40 to 46 and 50 to 53 with respect to protective tubes 30, 30*a* is such that the openings formed by the bushes and the tubes are aligned with one another, so that a connecting bolt 70 to be described in greater detail hereinafter, can be passed through the openings.

In accordance with the embodiment of FIG. 2, the articulation and connecting mechanism 20 has the following construction. Articulated bush 50 on stabilizer 13 is connected to articulated bush 40 on rudder blade 11 . This is followed by articulated bush 41 on rudder blade 11 to which is connected articulated bush 51 on stabilizer 13. This is followed by articulated bush 42 of rudder blade 11, articulated bush 43 also on rudder blade 11, articulated bush 52 on stabilizer 13, articulated bush 44 on rudder blade 11, articulated bush 45 also on rudder blade 11, articulated bush 53 on stabilizer 13 and the lower termination is formed by articulated bush 46 on rudder blade 11. Thus, in the embodiment of FIG. 2, there are in all eleven articulated bushes.

In each case, two articulated bushes, one being fixed to rudder blade 11 and the other to stabilizer 13, are supported on one another, accompanied by the interposing of an annular centering device. Thus, annular centering device 60 is placed between the two articulated bushes 50, 41, a second centering device 60*a* between articulated bushes 51, 42, a third centering device 60*b* between articulated bushes 52, 44 and the fourth centering device 60*c* between articulated bushes 53 and 46. As shown in FIG. 2, above protective tube 30 are provided articulated bushes 40, 50, 41, 51 and 42 in gap 31 between the two protective tubes 30, 30*a* articulated bushes 43, 52 and 44 and below the bottom protective tube 30*a* articulated bushes 45, 53 and 46. In this arrangement of the articulated bushes, the annular centering devices 60, 60*a*, 60*b* and 60*c* are arranged between bushes 50, 41 and 51, 42 and 52 and 44, 53 and 46.

A random number of articulated bushes can be used in each case. Advantageously, the bushes are arranged in such a way that there is a two-point bearing of the connecting bolt 70 or a three-point bearing corresponding to FIG. 2.

Articulated bushes 40 to 46 and 50 to 53 are made from high-grade steel. However, it is also possible to internally provide each bush with a connecting bolt feed sleeve, which is also made from high-grade steel. Such sleeves are designated by 59 and 49 in connection with articulated bushes 51 and 42 in FIG. 3.

The centering devices 60, 60*a*, 60*b* and 60*c* provided in connection with connecting mechanism 20 are mounted in free-floating manner between the particular articulated bushes and take up the axial weight. In addition, they are self-adjusting, so that in each case the upper articulated bush can be supported on in each case the lower articulated bush accompanied by the interposing of the centering device mounted in free-floating manner.

As all the centering devices 60, 60*a*, 60*b* and 60*c* have an identical construction, centering device 60*a* shown in FIG. 3 will be described hereinafter.

Centering device 60*a* comprises a torus or ring 61 mounted in free-floating manner and supported on a torus or ring 65 made from plastic, particularly polyamide. Torus 61 is made from high-grade steel and is supported on plastic torus 65. To achieve a free-floating mounting of torus 61, the superimposed wall and sliding surfaces 62 and 66 of the two tori 61, 65 are inclined downwards towards the longitudinal axis 15 of connecting mechanism 20. Sliding surface 66 of plastic torus 65 of the two tori 61, 65 supported on one another has an inclination angle of approximately 15° to its horizontally directed base surface 67. Sliding surface 62 of torus 62 has a slope corresponding to that of sliding surface 66 of plastic torus 65.

The internal diameter of the two tori, 61, 65 of centering device 60, 60*a*, 60*b* or 60c corresponding to the internal diameter of articulated bushes 40, 46 and 50 to 53 used, whilst the internal diameter of protective tubes 30, 30*a* is larger because no guidance and engagement of connecting bolt 70 is required and the protective tubes do not act as an articulated connection.

To increase the slidability of torus 61 of centering device 60, 60*a*, 60*b* or 60*c* a further torus 80 made from a plastic material, particularly polyamide is arranged above each torus 61 and on it is supported the particular articulated bush, in the manner shown in FIG. 3.

The connecting bolt 70 passed through the internal openings of protective tubes 30, 30*a*, articulated bushes 40 to 46 and 50 to 53 and centering devices 60, 60*a*, 60*b*, 60*c* comprises a plurality of individual bolts. In the case of embodiments shown in FIG. 2, there are three individual bolts 70*a*, 70*b*, 70*c*, which are detachably interconnected by means of screw bolts, cotter pins, etc 75. Through the use of detachably interconnected individual bolts an articulated connection is provided between stabilizer 13 and rudder plate 11 in which the particularly stressed parts of the connecting bolt 70 can be effortlessly replaced by corresponding new individual bolts, when such a replacement is necessary due to wear. The individual bolts of the overall connecting bolts 70 indicated in the vicinity of protective tubes 30, 30*a* are removed for replacement purposes and the no longer usable individual bolts are again introduced into the inner area of protective tubes 30 or 30*a* and connected to the replaced new individual bolts, so that even after a replacement of individual bolts a through and continuous connecting bolt 70 is obtained. The length of the individual bolts 70*a*, 70*b*, 70*c* used is such that a number of individual bolts corresponding to the number of protective tubes 30 or 30*a* used can be housed in the inner area of the latter, so that said individual bolts are available as replacement bolts (FIG. 2). The number of protective tubes 30 and 30*a* will always depend on the height of the rudder blade. The number of individual bolts required for producing the connecting bolt 70 will then also depend on the rudder height and the number of protective tubes used. Through the use of said protective tubes 30, 30*a* in the vicinity of connecting mechanism 20, it is possible to carry individual replacement bolts in space-saving manner.

The individual bolts are replaced in the bottom area of the overall connecting mechanism 20. The insertion opening for connecting bolt 70 is closed at the bottom in such a way that the opening of said closure is possible at all times in order to remove connecting bolt 70 or its individual bolts.

The weight distribution of stabilizer 13 on rudder blade 11 is indicated by arrows X in FIG. 6.

FIG. 7 shows the rudder 10 for watercraft illustrating the relation of the rudder blade 11 to the stabilizer 13.

I claim:

1. Rudder for watercraft, particularly ocean-going and inland navigation vessels and for floating gear, comprising a rudder blade and a stabilizer, first articulated bushes connected to said stabilizer, second articulated bushes connected to said rudder blade, a common connecting bolt extending axially through said first and second bushes for articulating said stabilizer and said main rudder, said first and second bushes and said common connecting bolt extending in the upward direction, the improvement comprising axially aligned upwardly extending protective tubes (30,30*a*) are connected to said stabilizer with said tubes disposed in axially spaced relation and forming at least one axially extending gap (31) between the adjacent ends of said tubes, said tubes including an uppermost tube (30) and a lowermost tube (30*a*), at least one said first bush and one said second bush arranged above said uppermost tube (30), at least one said first bush and one said second bush located below said lowermost tube (30*a*) and at least one said first bush and one said second bush located in said gap (31) between said tubes (30,30*a*), a selfadjusting annular centering device is located between each of said first and second bushes located above said uppermost tube below said lowermost tube and in said gap between said tubes, each said centering device (60,60*a*,60*b*,60*c*) receives the axial weight in a free-floating manner, each said centering device comprises an upper high-grade steel torus (61) and a lower plastic torus (65), said steel torus having a lower wall surface (62) in sliding contact with an upper surface on said plastic torus (65) with the sliding surface of said steel torus and plastic torus inclined downwardly and inwardly toward the axis of said connecting bolt, said upper surface of said plastic torus has an angle of approximately 15° relative to the horizontal, said lower surface (62) of said steel torus (61) has a corresponding inclination to the horizontal, and said connecting bolt extends through said tubes (30,30*a*) and said first and second bushes (40-46, 50-53) and through said annular centering devices (60,60*a*,60*b*,60*c*), said connecting bolt comprises a series arrangement of detachable interconnectable individual bolts (70,70*b*,70*c*), and means for detachably interconnecting said bolts.

2. Rudder, as set forth in claim 1, wherein each of said first and second bushes is formed of high grade steel.

3. Rudder, as set forth in claim 1, wherein each of said first and second bushes comprises a bolt guide sleeve (59,49), formed of a high grade steel.

4. Rudder, as set forth in claim 1, comprises in series from the upper end of said rudder blade and stabilizer toward the lower ends thereof:

(a) said second bushes include an uppermost second bush fixed to said rudder blade (11), (b) said first bushes include an uppermost first bush located below said uppermost second bush and spaced downwardly from said uppermost second bush and fixed to said stabilizer (13), (c) a first said centering device (60) in contact with the lower end of said uppermost first bush, (d) said second bushes include a first lower second bush in contact with the lower side of said first centering device and fixed to said rudder blade, (e) said first bushes include a first lower first bush spaced below said first lower second bush and fixed to said stabilizer, (f) a second said centering device located below and in contact with the lower end of said first lower first bush, (g) said second bushes include a second lower second bush in contact with the lower side of said second centering device and fixed to said rudder blade, (h) said uppermost tube fixed to said stabilizer is spaced below the second lower second bush, (i) said second bushes include a third lower second bush spaced below said uppermost tube and fixed to said rudder blade, (j) said first bushes include a second lower first bush spaced below said third lower second bush and fixed to said stabilizer, (k) a third said centering device located below and in contact with the lower end of said second lower first bush, (l) said second bushes include a fourth lower second bush located below and in contact with the lower surface of said third centering device, (m) said lowermost tube spaced below said fourth lower second bush and fixed to said stabilizer, (n) said second bushes includes a fifth lower said second bush spaced below said lowermost tube and fixed to said rudder blade, (o) said first bushes includes a third lower first bush spaced below said fifth lower second bush and fixed to said stabilizer, (p) a fourth said centering device located below and in contact with the lower end of said third lower first bush, (q) said second bushes include a sixth lower second bush in contact with the lower side of said fouth centering device and fixed to said rudder blade, and (r) said connecting bolt comprising three said detachably interconnectable individual bolts with said connecting bolt passing through all of said first and second bushes, through said uppermost and lowermost tubes and through said first, second, third and fourth centering devices.

* * * * *